US006161913A

United States Patent [19]

Childers et al.

[11] Patent Number: 6,161,913

[45] Date of Patent: Dec. 19, 2000

[54] METHOD AND APPARATUS FOR PREDICTION OF INKJET PRINTHEAD LIFETIME

[75] Inventors: Winthrop D. Childers; Thomas M. Sabo, both of San Diego, Calif.

[73] Assignee: Hewlett-Packard Company, Palo Alto, Calif.

[21] Appl. No.: 08/857,120

[22] Filed: May 15, 1997

[51] Int. Cl.[7] ..... B41J 29/393

[52] U.S. Cl. ..... 347/19

[58] Field of Search ..... 347/7, 19, 92, 347/23

[56] References Cited

U.S. PATENT DOCUMENTS

| | | | |
|---|---|---|---|
| 4,301,459 | 11/1981 | Isayama et al. | 347/19 |
| 4,506,276 | 3/1985 | Kyser et al. | 347/7 |
| 4,518,974 | 5/1985 | Isayama | 347/92 |
| 4,551,000 | 11/1985 | Kanemitsu et al. . | |
| 4,803,521 | 2/1989 | Honda . | |
| 4,961,088 | 10/1990 | Gilliland et al. . | |
| 5,021,828 | 6/1991 | Yamaguchi et al. . | |
| 5,138,344 | 8/1992 | Ujita . | |
| 5,184,181 | 2/1993 | Kurando et al. . | |
| 5,272,503 | 12/1993 | LeSueur et al. . | |
| 5,365,312 | 11/1994 | Hillmann et al. . | |
| 5,410,641 | 4/1995 | Wakabayashi et al. . | |
| 5,477,244 | 12/1995 | Shibata et al. | 347/19 |
| 5,500,657 | 3/1996 | Yauchi et al. | 347/9 |
| 5,506,611 | 4/1996 | Ujita et al. . | |
| 5,610,635 | 3/1997 | Murray et al. . | |

FOREIGN PATENT DOCUMENTS

| | | | |
|---|---|---|---|
| 0593282A2 | 10/1993 | European Pat. Off. | B41J 2/175 |
| 0709208A1 | 5/1996 | European Pat. Off. | B41J 2/175 |
| 0720916A2 | 7/1996 | European Pat. Off. | B41J 2/175 |
| 0744296A1 | 11/1996 | European Pat. Off. | B41J 2/175 |
| 03136865 | 6/1991 | Japan | B41J 2/175 |
| 06320732 | 11/1994 | Japan | B41J 2/05 |

OTHER PUBLICATIONS

European Search Report re: European Applic. No. EP 98303550, Berlin, dated Nov. 24, 1999.

*Primary Examiner*—John Barlow
*Assistant Examiner*—Charles W. Stewart, Jr.

[57] ABSTRACT

It has been discovered that inkjet printhead lifetime is related to an amount of accumulated air within the inkjet printhead. The invention, therefore, comprises a method of: determining an amount of ink that is output by an inkjet printhead during a determined period; using the amount of ink so determined to derive an update air accumulation value that is indicative of an amount of air which has accumulated during the determined period within the inkjet printhead; and updating a stored air accumulation parameter in accord with the air accumulation update value. The stored air accumulation parameter is thus related to a projected remaining lifetime of the inkjet printhead. A preferred embodiment stores the air accumulation parameter directly on a memory that is integral with the inkjet printhead. The parameter can further be stored on a memory that is resident on an ink container employed in the inkjet printer.

16 Claims, 6 Drawing Sheets

METHOD AND APPARATUS FOR PREDICTION OF INKJET PRINTHEAD LIFETIME

FIELD OF THE INVENTION

This invention relates to inkjet printers and, more particularly, to a method and apparatus for enabling assessment of remaining lifetime of an inkjet printhead.

BACKGROUND OF THE INVENTION

Presently, inkjet printers employ two different kinds of inkjet printheads: those which include an integral ink supply and are typically thrown away when the ink supply is exhausted; and those wherein the printhead is connectable to a replaceable container, enabling longer usage of the printhead. In the former type of disposable printhead, typically the printhead is thrown away prior to an occurrence of any printhead failure mechanism. With respect to the latter or "semi-permanent" category of printheads, a number of known failure modes have been experienced.

In printheads which employ heater resistors to cause ejection of droplets of ink, resistor burnout has been a problem. However, redesign of resistor structures and modification of resistor materials has largely eliminated the problem. A further failure mechanism is a buildup of scum within the ink chamber, juxtaposed to the heater resistor. Changes in ink composition are able to largely overcome this problem.

The prior art has suggested that inkjet printheads incorporate a parameter memory for storage of operating parameters to be used by the inkjet printer. Such parameters include: drop generator driver frequencies, ink pressure and drop charging values. Such a printhead is described in "Storage of Operating Parameters in Memory Integral with Printhead", Lonis, Xerox Disclosure Journal, Volume 8, No. 6, November/December 1983, page 503. Other patents have suggested that an ink-containing replaceable cartridge can be provided with an integral memory for storage of information relating to control parameters for a connected inkjet printer. For instance, U.S. Pat. No. 5,138,344 to Ujita stores information on a replaceable ink cartridge which relates to control parameters for the printer. U.S. Pat. No. 5,365,312 to Hillmann et al. describes the use of a memory device integral with an ink reservoir for storage of ink consumption data. European patent EP 0 720 916 describes an ink reservoir which includes a memory for storage of data regarding the identity of the ink supply and its fill level.

It is an object of this invention to provide a replaceable cartridge for use in an ink jet apparatus (i.e. a printer, copier, plotter and the like), which cartridge includes memory with data that enables a projection to be made of further remaining printhead lifetime.

It is another object of this invention to provide an improved method for determining printhead lifetime.

SUMMARY OF THE INVENTION

It has been discovered that inkjet printhead lifetime is related to an amount of accumulated air within the inkjet printhead. The invention, therefore, comprises a method of: determining an amount of ink that is output by an inkjet printhead during a determined period; using the amount of ink so determined to derive an update air accumulation value that is indicative of an amount of air which has accumulated during the determined period within the inkjet printhead; and updating a stored air accumulation parameter in accord with the air accumulation update value. The stored air accumulation parameter is thus related to a projected remaining lifetime of the inkjet printhead. A preferred embodiment stores the air accumulation parameter directly on a memory that is integral with the inkjet printhead. The parameter can further be stored on a memory that is resident on an ink container employed in the inkjet printer.

DETAILED DESCRIPTION OF THE INVENTION

Figure 1:
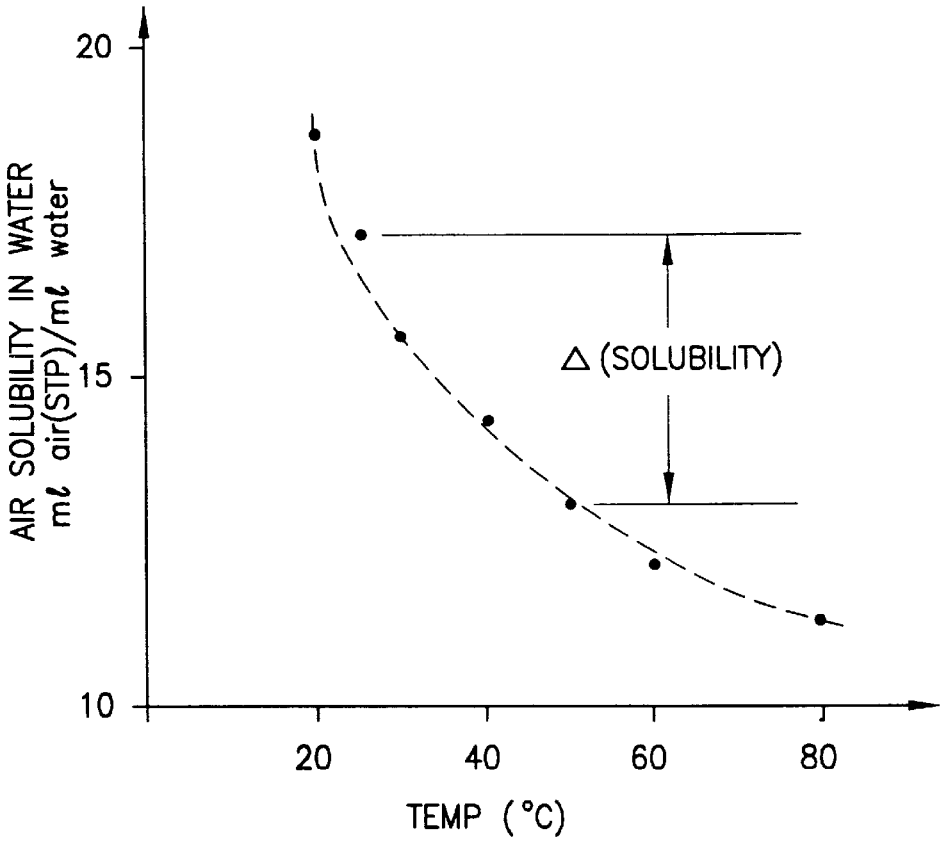
FIG. 1 is a plot of the solubility of air in water versus temperature.

It has recently been discovered that inkjet printhead failure can occur as a result of temperature-induced outgassing of air from ink passing through the printhead. This problem especially appears when inks are used that are adapted for "plain paper" and that further provide a high edge acuity in the printed characters. These inks tend to be mostly water-based. Water is known to have a relatively steep solubility curve, such as shown in FIG. 1. There, changes of air solubility in water is plotted against temperature (degrees Centigrade), showing an exponential decrease in solubility with increases in temperature. It is clear from the curve of FIG. 1, that air solubility in water decreases rapidly as temperature is increased.

Many ink jet printheads employ heater resistors to enable the ejection of ink droplets and, further, are often supplied with additional heating to assure constant performance characteristics over a wide range of temperatures. The additional heating is known as pulse-warming. The resulting increased temperatures tend to exacerbate the outgassing of air from ink passing through the inkjet printhead.

If an inkjet printhead is used in a high use-rate environment, such as large format printing or high speed copiers, it has been determined that the problems arising from outgassing become more severe. In such applications, a printhead will tend to be semi-permanent. More specifically, multiple ink containers are used over the lifetime of the printhead to supply ink to the printhead. Thus, over a printhead's lifetime, multiple liters of ink will pass through the printhead, thereby enabling substantial air accumulation to occur within the printhead structure.

Figure 2:
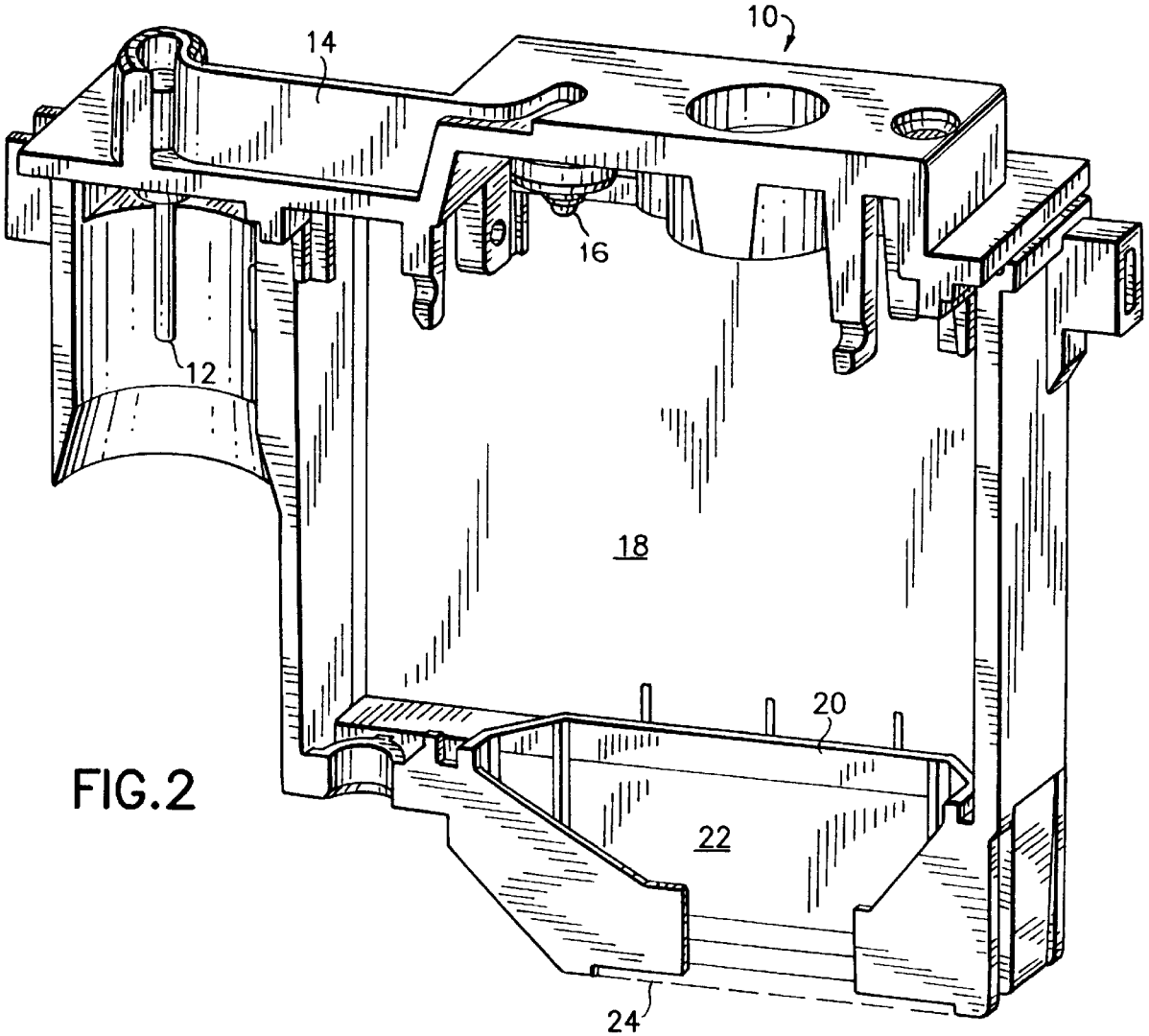
FIG. 2 is a sectional view of a portion of an inkjet printhead showing interior sections thereof.

Referring to FIG. 2, a sectional view of a printhead, with some internal parts missing, is illustrated. Inkjet printhead 10 employs a hollow needle 12 that mates with an inlet conduit from an ink supply cartridge (not shown). The ink travels up hollow needle 12, through channel 14 and down to a valve 16. Valve 16 is normally closed, but will open in response to a vacuum condition within upper ink chamber 18, thereby enabling an inflow of ink thereinto. Ink flows from upper ink chamber 18, through a filter element 20, into lower ink chamber 22, and thence into ink pen element 24 (shown in phantom). Further description of the structure of printhead 10 and ink pen element 24 can be found in U.S. Pat. No. 5,278,584, the disclosure of which is incorporated herein by reference.

It has been found that air accumulates within lower ink chamber 22 both above and below filter element 20. If air accumulates to a sufficient degree below filter element 20 (and in lower ink chamber 22), the print pen 24 becomes starved for ink, as the accumulated air blocks the path of ink flow. If air accumulates to an even greater extent, both above and below filter element 20, temperature excursions may cause an expansion of the air and create a pressure situation within printhead 10 which will cause a "drooling" of ink from ink pen element 24. Such drooling can result in printer damage.

It has been assumed that keeping track of the number of ink droplets ejected from printhead 10 would be sufficient to enable a calculation of the amount of outgassed air from ink passing through printhead 10. Such a value would enable a signalling of when the accumulated air had reached a critical level. It has been found, however, that a calculation of air outgassed derived from a count of ink drops fired (and a conversion of the count to an ink volume value) provides a less than satisfactory indication of air accumulation. In this regard, it has been found that a residence time of ink within printhead 10 has a significant effect on the outgassing value. This is as a result of the fact that the longer ink is resident within printhead 10, the longer the ink is subjected to an elevated temperature, as a result of heat applied to pen element 24, and the more outgassing occurs as a result of that exposure.

The effect of residence time can be explained further as follows. Ink that flows into the lower ink chamber 22 and is finally ejected through ejection elements 24 has a certain amount of dissolved air. With a convection mechanism, the ejection elements 24 warm the ink as it enters lower chamber 22. Because the solubility of air in the ink decreases as the ink is warmed, the ink can become supersaturated as it approaches ejection elements 24. This supersaturation causes air to diffuse into bubbles in lower ink chamber 22 and to a lesser extent into bubbles in upper chamber 18. As is well known, the total mass diffused across an interface (in this case from ink to a bubble) increases with the initial concentration gradient (affected by the temperature) and time. In the limit as the residence time gets sufficiently large, air diffusion will take place until the ink in lower ink chamber 22 is no longer supersaturated—i,e, . all of the "excess" air will have diffused into the bubbles in ink chamber 22. On the other hand, as the residence time gets short, there is very little time for diffusion and hence less total air diffuses out of the ink (per unit volume of ejected ink).

The residence time of ink within printhead 10 is directly related to the print density produced by printhead 10 during the course of a print action. For instance, a graphics print job and a text print job may result in considerably different residence times of ink within printhead 10. Thus, a particular user's use pattern will have a major influence on how much ink can be delivered through a printhead before that printhead experiences a level of air accumulation which can cause a failure of the printhead.

Figure 3:
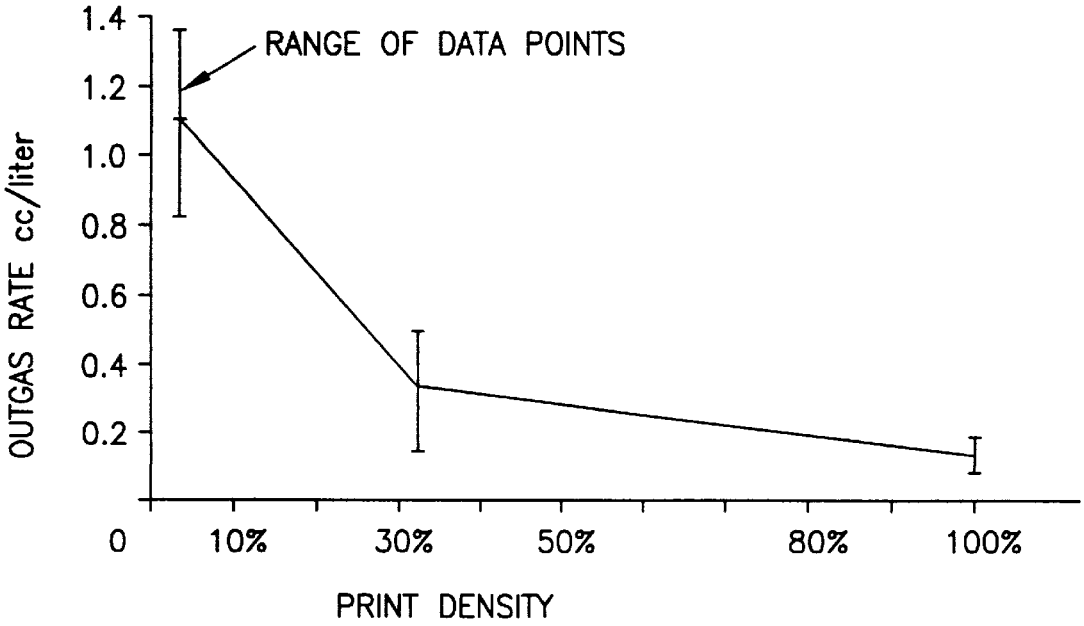
FIG. 3 is a bar graph illustrating changes in air accumulation rate within an inkjet printhead for various levels of print density.

Referring to FIG. 3, the phenomena of air accumulation, with changes in print density will become more apparent. Shown is the outgas rate plotted against print density for an exemplary printhead structure. (It is to be understood that the indicated outgas relationship will change according to printhead design, ink type, pulsewarming algorithm, etc.) The vertical axis indicates the outgas rate in cubic centimeters of air outgassed into lower ink chamber 22 per liter of ink that is ejected by ejection elements 24. The horizontal axis indicates the area coverage, where 100% indicates a "blackout" area fill (a drop ejected at every dot matrix location) and lower percentages indicating the fraction of area coverage.

Note that as the print density decreases, the amount of air accumulated within printhead 10, per liter of ink expelled onto media, substantially increases. This can be understood by realizing that when a printhead prints at a low print density, less ink is utilized by the printhead, thereby leading to a longer residence time of the ink within the printhead and a greater opportunity for outgassing of air therefrom. Thus, as print density increases, residence time of the ink within the printhead lessens and the opportunity for air outgassing likewise decreases.

Figure 4:
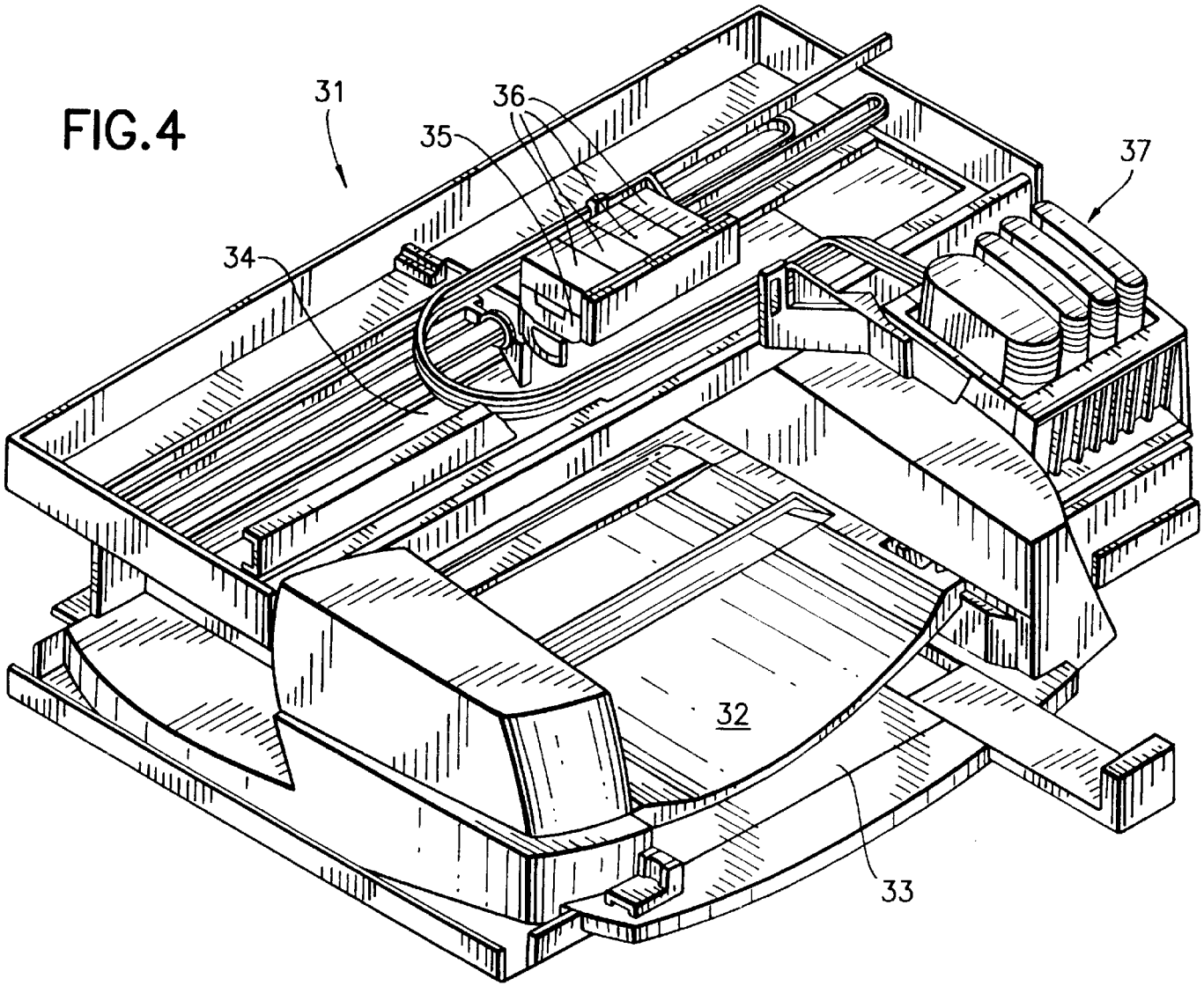
FIG. 4 is a perspective view of an inkjet printer (with cover removed) which incorporates the invention.

Prior to describing the method of the invention, reference should be made to FIG. 4 which is a perspective view of an inkjet printer 31 which incorporates the invention. A tray 32 holds a supply of input paper or other print media. When a printing operation is initiated, a sheet of paper is fed into printer 31 and is then brought around in a U-direction towards an output tray 33. The sheet is stopped in a print zone 34, and a scanning cartridge 35, containing plural removal color printheads 36 is scanned across the sheet for printing of a swath of ink thereon. The process repeats until the entire sheet has been printed, at which point it is ejected into output tray 33.

Printheads 36 are respectively, fluidically coupled to four removable ink cartridges 37 holding, for example, cyan, magenta, yellow and black inks, respectively. Since black ink tends to be depleted most rapidly, the black ink cartridge has a larger capacity than the other ink cartridges. As will be understood from the description which follows, each printhead and ink cartridge is provided with an integral memory device which stores data that is used by printer 31 to control its printing operations and to enable a printhead lifetime value to be calculated and stored.

Figure 5:
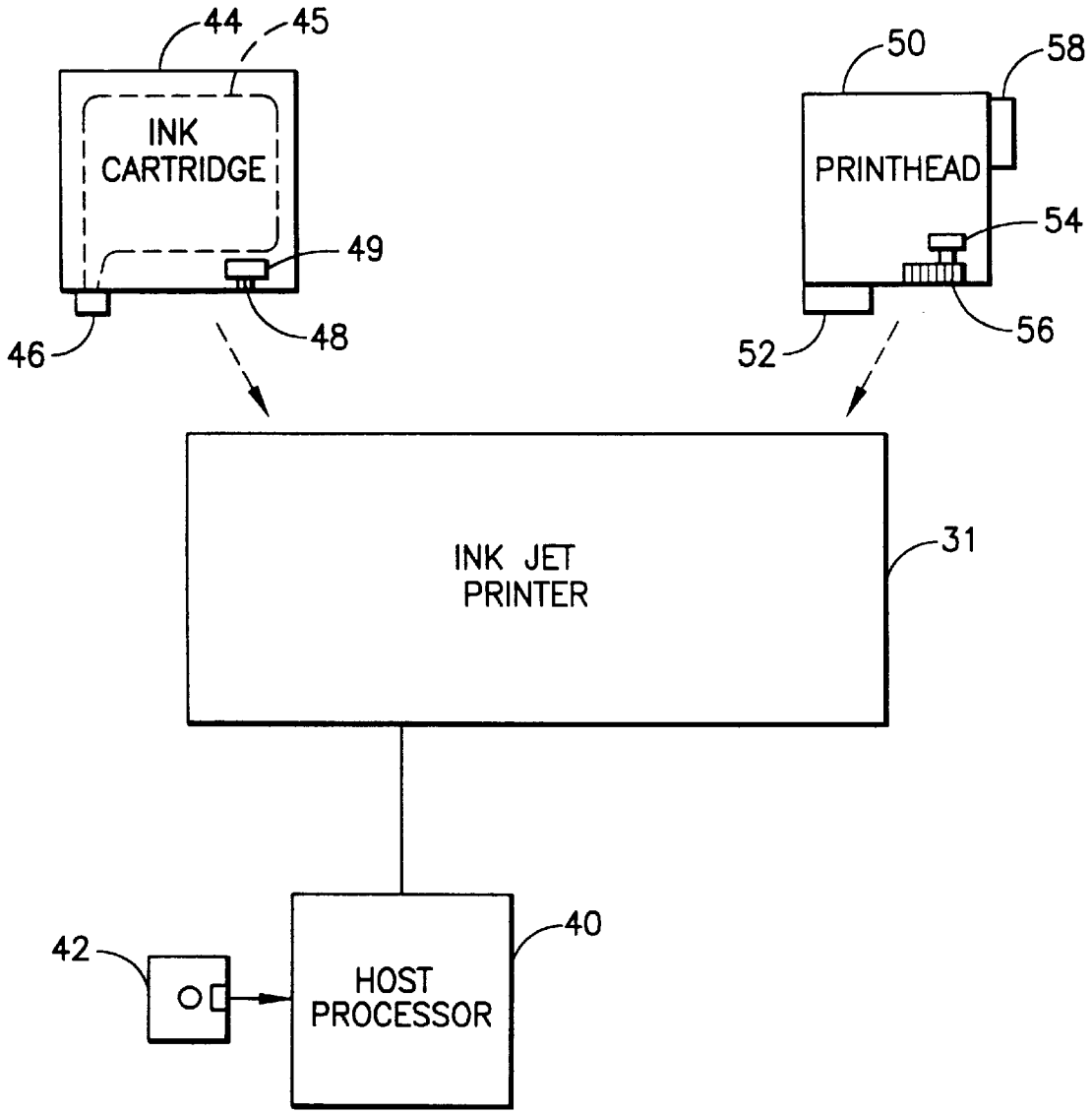
FIG. 5 is a block diagram of an inkjet printer of FIG. 1, showing replaceable elements therefore, including an ink cartridge and a printhead.

In FIG. 5, a schematic view of elements of inkjet printer 31 shows host processor 40 connected thereto. Host processor 40 connected thereto. Host processor 40 provides both control and data signals for inkjet printer 31 and is adapted, in the known manner, to receive a memory media cassette 42 which includes operating program data for control of inkjet printer 31. A replaceable ink cartridge 44 includes a reservoir 45 which holds a supply of ink, a fluidic coupler 46 and an electrical connector 48, both of which couple to mating connectors within ink jet printer 31 upon installation of ink cartridge 44. A memory chip 49, installed on ink cartridge 44 is coupled to connector 48 and upon insertion of ink cartridge 44, is electrically coupled to a microprocessor within inkjet printer 31.

A printhead 50 also includes a fluid coupler region 52, a resident memory 54 and an electrical connector 56 which connects to memory 54. Other sense and control devices are present within printhead 50, such as heater resistors for causing ejection of ink droplets from pen segment 58.

Figure 6:
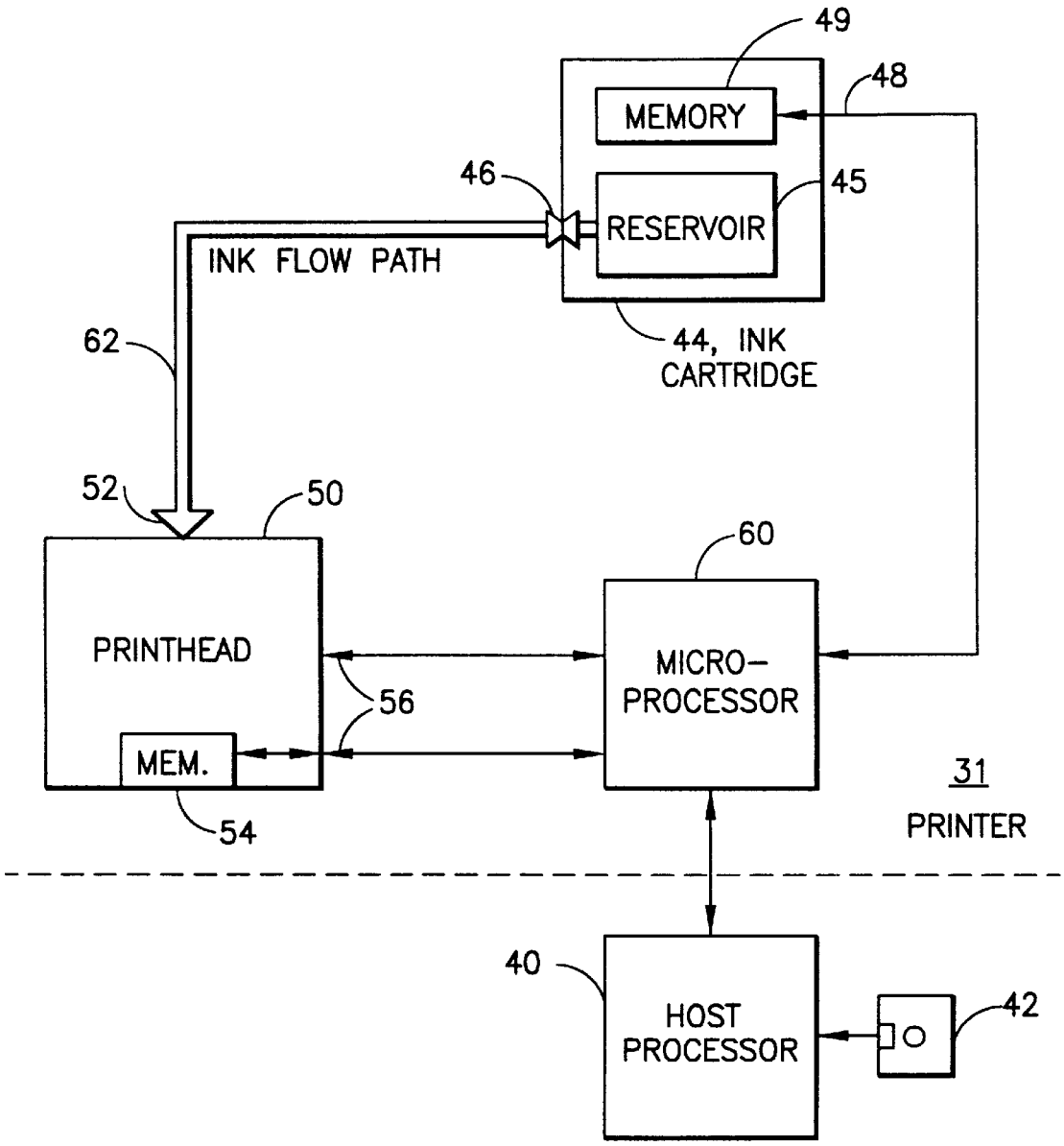
FIG. 6 is a block diagram showing connections of the components within the inkjet printer of FIG. 1.

FIG. 6 illustrates inner connections within inkjet printer 31 between a microprocessor 60, which controls the operation of inkjet printer 31, ink cartridge 44 and printhead 50. An ink flow path 62 provides a flow path between ink cartridge 44 and printhead 50.

Memory chip 54 on printhead 50 includes a variety of parameters recorded therein, one of which, preferably, is an air accumulation parameter that is indicative of an amount of air accumulated within printhead 50. Memory 54 can also include a variety of other parameters, one of which is a value which enables droplet volume to be determined by microprocessor 60.

Figure 7:
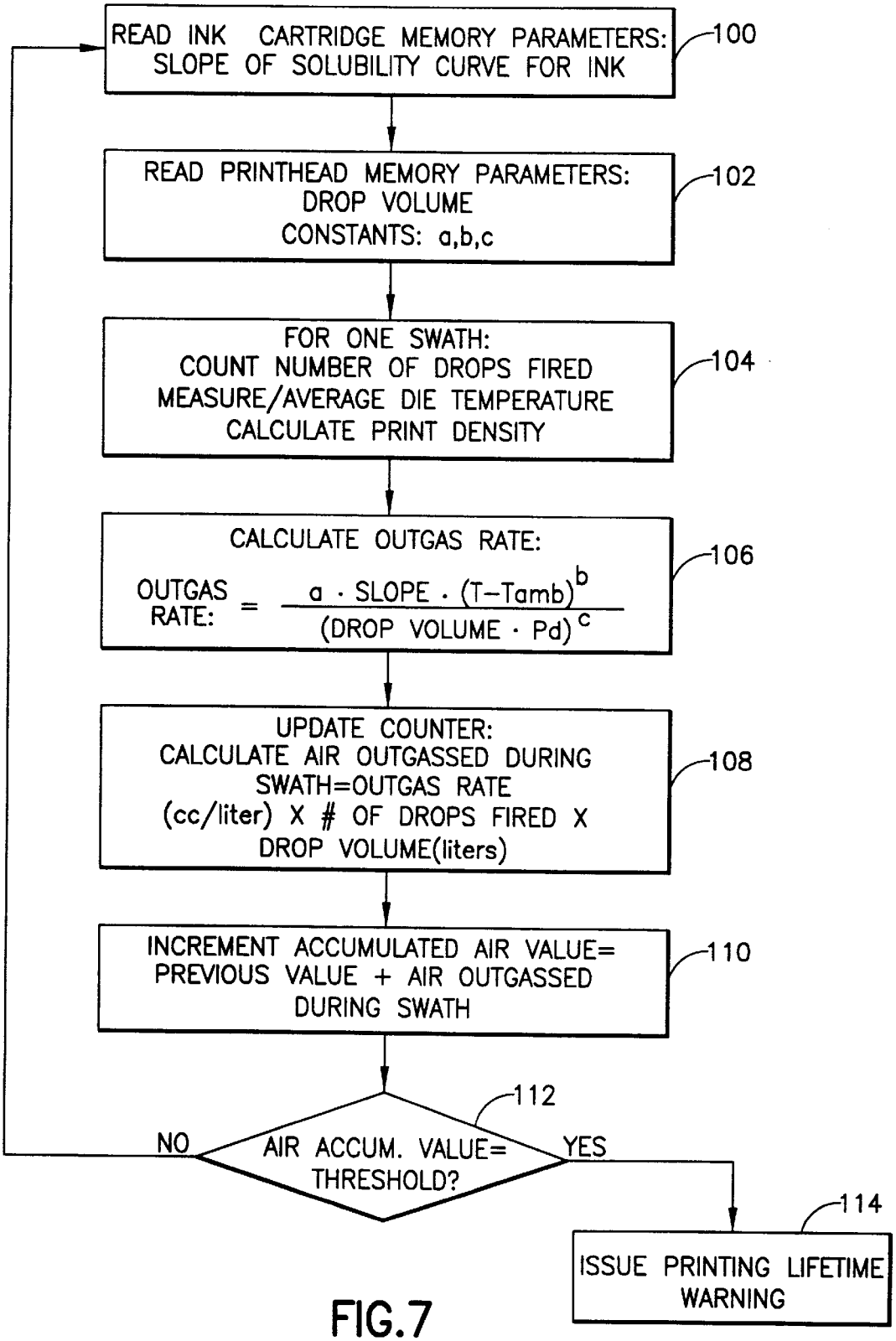
FIG. 7 is a logic flow diagram illustrating the method of the invention.

Turning to FIG. 7, a logic flow diagram is shown which illustrates the procedure employed to determine air accumulation update values for the air accumulation parameter stored in printhead memory 54. Initially (box 100), ink cartridge memory 49 is accessed and a parameter indicative of the slope of the air solubility curve for the ink in ink cartridge 44 is read. Printhead memory 54 is then read and the following parameters are read: a drop volume parameter; and certain constants (a, b and c) that will be used in calculating an outgas rate for the ink as it passes through printhead 10 (box 102).

During operation of printhead 10 in printing a swath, the following data is accumulated: a count of fired ink droplets and a measure of the average temperature of a die within printhead 10 (box 104). A print density (Pd) value is then calculated by microprocessor 60. The Pd value is a value which varies between zero and one. For a full black swath, the Pd value is set at one, and for a full white swath, the print density is set to zero.

The Pd value can be calculated by knowing that approximately 1 cubic centimeter of ink provides a 100% print density on a normal 8-½×11 paper sheet. Thus, by knowing the number of ink droplets fired after the printing of a swath, the volume of ink emitted can be calculated, utilizing a drop volume parameter from printhead memory 54. Based upon the ratio of the calculated volume of ink placed on a swath page vs. the amount of ink required to produce a 100% print density swath, a value between zero and one is determined that is indicative of the respective swath's print density.

Concurrent with the calculation of print density, the die temperature (T) is accessed and, utilizing the air solubility slope parameter value and constants a, b and c from printhead memory 54, an outgas rate is calculated (box 106) using the following relation:

$$\text{Outgas rate} = \frac{a * \text{slope} * (T - T_{amb})^b}{(\text{drop vol} * Pd)^c}$$

The above relationship is used to calculate the outgassing rate to enable an amount of air outgassed to be calculated. Constant a is an overall constant of proportionality that takes into account unit conversions. "Slope" is an approximate slope of the solubility curve in the temperature range of interest. Although the solubility curve shown in FIG. 1 is not linear, an approximate slope value can be used, between $T_{amb}$ (ambient temperature of roughly 25° C.) and the operating temperature (typically roughly 50° C.). Note that a particular ink will have its own curve that is similar to FIG. 1; however, many inks tend to have curves that are not as steep over the temperature range of interest. Constant b is approximately 1, but may be adjusted to help take into account the solubility curve non-linearity.

Constant c is used to match the flow rate of ink to the shape of an empirical curve as shown in FIG. 3. To take into account the effect illustrated in FIG. 3, the outgas rate has a denominator that is proportional to the flow rate of ink through the printhead, raised to a power c (an empirical constant).

Thereafter, the air outgassed is calculated (box 108) in accordance with the expression:

Air amount=outgas rate×no. of droplets×droplet volume

The resultant number is the amount of air in cc's that is has outgassed from the ink (assuming the outgas rate is in cc's per liter and the droplet volume is in liters). This calculation may be done on a per swath, per portion of a page or full page basis, or for some total number of dots, depending on what is best for a particular printing system controller.

Thereafter, using the calculated air outgassed amount, a stored air accumulation value is updated (box 110) and the updated air accumulation value is compared to a pre-set threshold (decision box 112). If the air accumulation value is less than the threshold value, the procedure recycles. If the air accumulation value equals or exceeds the threshold value, microprocessor 60 provides a printhead lifetime warning to the user (box 114) indicating an imminent requirement to change the printhead.

As an alternative, the updated air accumulation value may be compared to plural threshold values, with a lower threshold value being utilized to provide a warning to the user and a higher or last threshold value being causing a disabling of further printing until the printhead is changed.

Accordingly, the invention enables a printhead lifetime parameter to be accumulated, based upon usage and ink residence time within the printhead. Further, by recording the air accumulation value directly on the printhead, if the user transfers the printhead from one printer to another, the lifetime procedure does not change, as the air accumulation value is continually updated as a result of the procedure shown in FIG. 7. Further, the air accumulation parameter can be stored on the memory that is resident on the ink cartridge.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for determining an inkjet printhead lifetime, said method comprising the steps of:

a) determining an amount of ink ejected from said inkjet printhead during a determined period;

b) using said amount of ink to derive an update value indicative of an amount of air accumulated within said inkjet printhead;

c) updating a stored air accumulation parameter in accord with said update value, said stored air accumulation parameter related to a projected remaining lifetime of said inkjet printhead.

2. The method as recited in claim 1, wherein said update value is related to a residence time of said ink in said inkjet printhead during said determined period.

3. The method as recited in claim 1, wherein said ink exhibits an air solubility that is variable with temperature, and step b) employs a temperature value in determining said update value.

4. The method as recited in claim 1, wherein said determined period is related to a time required to print a page.

5. The method as recited in claim 1, further comprising the step of:

d) comparing said stored air accumulation parameter with a threshold value and providing a printhead lifetime warning when said threshold value is exceeded by said air accumulation parameter.

6. The method as recited in claim 1, wherein said inkjet printhead includes a memory resident thereon, said air accumulation parameter being stored in said memory and step c) employs said update value to update said air accumulation parameter stored in said memory.

7. The method as recited in claim 1, wherein said amount of ink is determined by use of a count of ink drops emitted from said inkjet printhead during said determined period.

8. An inkjet printing system for determining an inkjet printhead lifetime, said inkjet printing system comprising:

an inkjet printhead;

a memory associated with said inkjet printhead, said memory for storing an air accumulation parameter;

an ink reservoir coupled to said inkjet printhead for supplying ink thereto; and processor means coupled to said inkjet printhead for (i) determining an amount of ink output by said inkjet printhead in a determined period, (ii) for using said amount of ink to derive an update value indicative of an amount of air accumulated within said inkjet printhead, and (ii) for updating said stored air accumulation parameter in accord with said update value, said stored air accumulation parameter related to a projected remaining lifetime of said inkjet printhead.

9. The inkjet printing system as recited in claim 8, wherein said update value is related to a residence time of said ink in said inkjet printhead during said determined period.

10. The inkjet printing system as recited in claim 8, wherein said ink exhibits an air solubility that is variable with temperature, and said processor employs a temperature value in determining said update value.

11. The inkjet printing system as recited in claim 8, wherein said determined period is related to a time required to print a page.

12. The inkjet printing system as recited in claim 8, wherein said processor compares said stored air accumulation parameter with a threshold value and provides a printhead lifetime warning when said threshold value is exceeded by said air accumulation parameter.

13. The inkjet printing system as recited in claim 8, wherein said processor determines said amount of ink by use of a count of ink drops emitted from said inkjet printhead during said determined period.

14. An ink container for an inkjet printing system, comprising:

a reservoir for holding a supply of ink;

conduit means for coupling said reservoir to an inkjet printhead; and a memory resident on said ink container and pluggably coupleable to a processor in an inkjet printer, said memory storing a value indicative of a change in solubility of air in said ink with temperature, said value enabling said processor to determine an amount of air that outgasses from said ink during residence time of said ink in said printhead.

15. An inkjet printhead for an inkjet printing system, comprising:

a region for holding a supply of ink received from an ink container;

outlet means for enabling a coupling of said region holding a supply of ink to said ink container; and a memory resident on said inkjet printhead and pluggably coupleable to a processor in said inkjet printer, said memory storing an air accumulation parameter related to a projected remaining lifetime of said inkjet printhead and a value indicative of a volume of an inkjet droplet emitted by said inkjet printhead.

16. An ink container for an inkjet printing system having a printhead, the printhead having a drop ejection element mounted thereon for ejecting ink onto media and a housing for conducting ink to the drop ejection element, the ink jet printing system of the type wherein an ink container is separately replaceable from the printhead, the printing system having a processor that controls printing, the ink container comprising:

a reservoir for holding a supply of ink;

a fluid outlet adapted to fluidically couple said reservoir to said printhead upon installation of said ink container into said printing system, to enable a flow of ink to said printhead;

a supply of ink having an air solubility characteristic which enables a release of entrained air into said housing of said printhead when ink drop ejection takes place; and a memory resident on said ink container, said memory coupled to said processor when said ink container is mounted in said printing system, said memory providing a parameter to said processor indicative of changes in solubility of air in said ink with changes in temperature, said parameter enabling said processor to calculate a rate at which air accumulates in said housing during a period of residence of the ink in said printhead.

* * * * *